United States Patent [19]

Reedy

[11] 4,295,459

[45] Oct. 20, 1981

[54] STOVE

[75] Inventor: Charles B. Reedy, Morelia, Mexico

[73] Assignee: Benedictine Monks Inc., Benet Lake, Wis.

[21] Appl. No.: 41,739

[22] Filed: May 23, 1979

[51] Int. Cl.[3] ..... F24C 1/00
[52] U.S. Cl. ..... 126/60
[58] Field of Search ..... 126/60, 59, 59.5, 58

[56] References Cited

U.S. PATENT DOCUMENTS

| | | | |
|---|---|---|---|
| 73,793 | 1/1868 | Frazier | 126/60 |
| 229,082 | 6/1880 | Berryhill et al. | 126/60 |
| 794,290 | 11/1910 | Merritt | 126/60 |

FOREIGN PATENT DOCUMENTS

| | | | |
|---|---|---|---|
| 558379 | 11/1922 | France | 126/60 |
| 861873 | 11/1940 | France | 126/60 |

*Primary Examiner*—Samuel Scott
*Assistant Examiner*—Wesley S. Ratliff, Jr.
*Attorney, Agent, or Firm*—Limbach, Limbach & Sutton

[57] ABSTRACT

A stove comprising an elongated fuel chamber having a door at one end, a chimney communicating with the chamber at a position in close proximity to said door-end in upper surface, an air inlet opening in upper surface of said fuel chamber at a point in close proximity to the other end and a slidable spatulate member adjacent to said air inlet opening for varying the area of said opening.

2 Claims, 2 Drawing Figures

STOVE

BRIEF DESCRIPTION OF THE INVENTION

The stove of the invention is comprised of an elongated fuel chamber. The fuel chamber may be cylindrical, hemi-cylindrical, prismatic in form or any trough-like shape. If the stove is intended for use only as a space heater, any cylindrical, hemi-cylindrical, trough-shaped or prismatic forms of the fuel chamber may be used. If, however, it is intended to use the stove for cooking, and additionally as a space heater, then the fuel chamber may be of any trough-like, curved or prismatic in form, provided with a flat surfaced top on which cooking may be done.

A door is provided at one end of the fuel chamber which can be opened for the introduction of fuel and closed and then held closed, for example, by a tightening latch after the fuel has been inserted. The other end of the fuel chamber is normally permanently closed, but it too could be provided with a door which could be used chiefly for opening the fuel chamber for cleaning. Two openings are provided in the top of the fuel chamber. One opening is adjacent to the fuel introduction door and is fitted with a chimney to provide for escape of the combustion gases and to provide a draft. The other opening in the top of the fuel chamber is in a position in close proximity to the closed end of the fuel chamber. This opening provides for downward access of air to support combustion of the fuel. A slidable spatulate plate for opening or closing or adjusting the area of the air inlet opening is provided. This spatulate member can merely sit on the upper surface of the fuel chamber or be pivoted and thereby be adjustable over any desired portion of the air inlet opening. If desired, parallel ridges can be provided running lengthwise of the fuel chamber and extending across the peripheries of the air inlet opening to guide the spatulate member. In the event that the fuel chamber is cylindrical in form, then the spatulate member would be curved so that its surface would conform to the upper surface of the fuel chamber, and in this event, the ridges would be most desirable in order to keep the spatulate member on the top surface of the fuel chamber. The fuel chamber may be supported by four legs, or by two legs having broad bases, of sufficient length to position the upper surface of the fuel chamber at a suitable height for use in cooking or space heating.

DETAILED DESCRIPTION OF INVENTION

Figure 1:
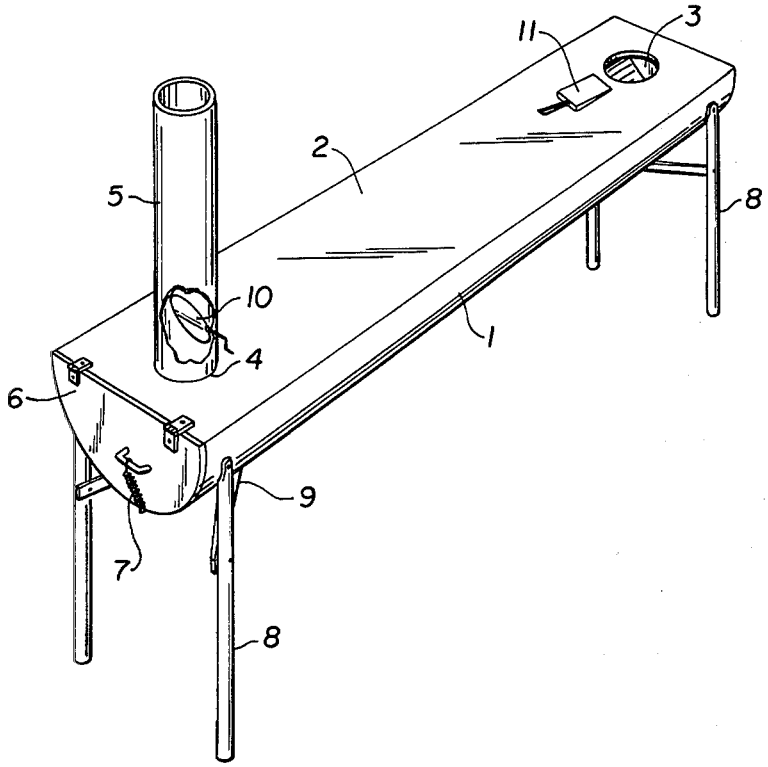
FIG. 1 is a general view of the stove as seen from a position above and to one side of the stove.
Figure 2:
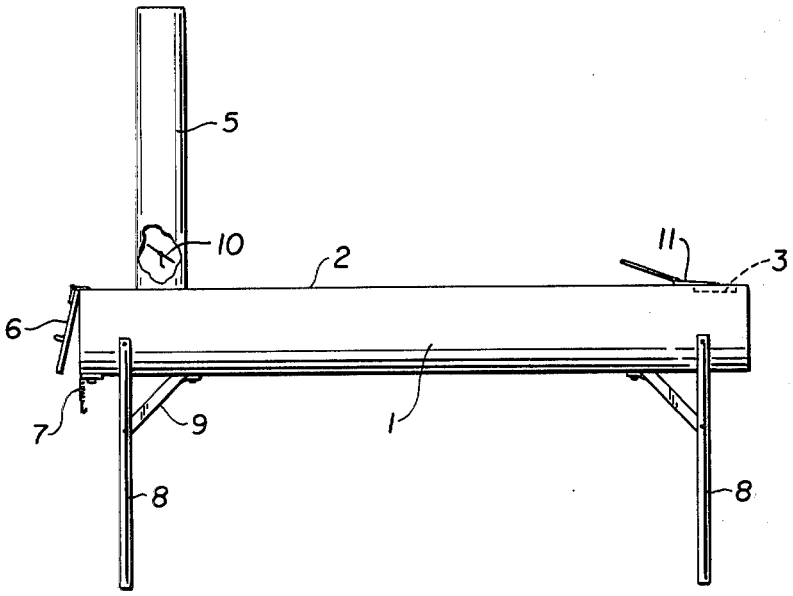
FIG. 2 is a side view of the stove.

Referring now to FIG. 1 of the drawing, hemi-cylindrical fuel chamber 1 has an upper flat surface 2. Air inlet opening 3 is positioned in close proximity to the normally closed end or permanently closed end of the fuel chamber. Chimney opening 4 is positioned in the flat surface in close proximity to the opposite end of the fuel chamber and is fitted with a chimney 5 which may be one or more lengths of stovepipe. Door 6 is fitted to the end of the fuel chamber adjacent to the chimney opening. It may be hinged as a matter of convenience. This door may be opened for the introduction of fuel and then closed and held in closed position by pressure latch 7 or some other suitable device. The fuel chamber may be supported by legs 8 which are of a length suitable to maintain the flat surface 2 at a convenient height above the floor upon which the legs rest. Chimney 5 may be fitted with a conventional moveable damper which may be used to help control the rate of burning. Spatulate member 11 rests on flat surface 2 and may be slid to cover any desired portion of air inlet opening 3. The rate of combustion of the fuel and hence the amount of heat generated and the temperature of the top surface of the stove can be controlled completely by varying the positions of the spatulate member 11 and chimney damper 10. Legs 8 may be pivotally attached to fuel chamber, and leg supports 9 may fit into a slot provided in legs 8 to permit folding of legs into positions generally parallel with the base of the fuel chamber, if desired.

The legs 8 adjacent to the air inlet opening may be hinged at an intermediate point to permit lowering of the end of the fuel chamber containing the air inlet opening to a position below the door opening end of the chamber when it is desired to obtain a greater space heating effect from a stove that is normally used for cooking and this provides gravity feeding of the fuel to the end of the chamber below the air inlet opening. This would require a hinged chimney joint.

The stove above described is an extremely simple and cheap device which can be constructed using the minimum of materials and parts, which is capable of being constructed in a humble shop with materials common on the market, and which will burn any type or shape of reasonably dry fuel that will fit into it, such as logs, sawdust, chips, coconut shells and husks, cactus leaves, charcoal, coal, trash, peach stones, seeds, etc.

Fuel chamber 1, door 6, chimney 5, and spatulate member 11 can all be made from sheet metal. Although 1/16th inch thickness is good, almost any metal thickness which maintains mechanical integrity is acceptable. If legs are attached to the stove, they can be made from metal rods, hollow steel metal forms, tubes, plates, etc. welded or otherwise fastened to the fuel chamber and of sufficient strength to support the fuel chamber, its contents and food being cooked. Or fuel chamber may be mounted directly upon a brick or clay, etc. type of base. The stove can also be constructed starting with a metal drum which is cut longitudinally to form a trough. Then a rectangular sheet is attached to the trough to provide a flat top. Chimney and air inlet openings are cut into the flat top and one end of the trough is cut out and provided with a fuel inlet door. Ordinary stovepipe may be fitted into the chimney opening to provide a chimney. For economy this legless stove may be mounted on a brick or clay base as that mentioned above. Or, more simply, a rectangular metal sheet with the necessary air entry opening, and chimney opening with stovepipe and with fuel entry door attached at stovepipe end can be mounted upon a pre-formed brick or clay trough which serves in place of the metal trough for still greater economy.

To operate the stove, door 6 is opened and fuel is pushed into fuel chamber along its entire length leaving a small space between the upper surface of the fuel body and upper surface of fuel chamber. Door 6 is then tightly closed. Then the damper 10 is placed in open position and spatulate member 11 is moved away from air inlet opening 3 to leave it at maximum opening. A match or a ball of burning paper, or a handful of dry grass or small twigs is ignited within the air inlet opening in contact with the fuel below the opening. For a very short time, usually a matter of seconds, there may be some smoke emission from the air inlet opening, but very quickly the combustion gases traverse the length of the fuel chamber and begin to ascend and heat the chimney. Then a strong draft is created at the air inlet opening. In a very short time the surface of the fuel chamber becomes quite hot. Combustion can then be adjusted to a desired rate by movement of the spatulate member and/or damper. From time to time, as combustion proceeds, door 6 can be opened and the fuel resident in the chamber can be pushed toward the air inlet opening of the combustion chamber and additional fuel added. Movement of the fuel can also be accomplished by a spring or a weighted pulley device or other suitable mechanical means. The stove can be used for toasting, cooking meats, certain vegetables, tortillas, etc. directly on the flat surface. Other foods can be cooked in pots and pans which rest on the upper surface of the fuel chamber. A simple metal box can be placed on the upper surface of the fuel chamber and, when closed, functions effectively as an oven.

This stove invention differs from more conventional stoves of the "up-draft" type with fuel storage above the zone in which combustion is occuring, which fuel obstructs radiation above on the surfaces to be heated. In the stove of the invention, combustion is restricted pretty much to the area of the top surface of the fuel immediately below the air inlet and the heat ascending passes along the entire length of the stove to the chimney opening, thus being distributed for use. Fuel chamber should be essentially air-tight, except for the air inlet and chimney openings. Suction created by the chimney brings a strong current of air through air inlet opening 3 to strike the fuel from above, causing flame and radiation to strike the cooking surface material. The downdraft through air opening 3 carries ash away from the surface of the fuel being burned leaving ash-free combustible material open to access by the incoming air. The ash and combustion gases flow over and through the fuel stored in the fuel chamber betwen the air inlet opening 3 and door 6. During passage of these gases through the fuel the greater part of the ash and soot contained in the combustion gases is caught by the fuel, and the fuel, if it is damp or wet, is pre-dried on its way to the combustion zone below air inlet opening 3. Since essentially all of the oxygen contained in the inlet air is consumed in the combustion zone, a sizable amount of unburned fuel can be stored in the combustion chamber without igniting.

The stove of the invention can be sized with great flexibility according to its intended use. Stoves intended for permanent use at a fixed location for cooking and heating may have fuel chambers ranging from 3 to 5 feet or more in length and upper flat surfaces of 12 to 30 or more inches in width. Stoves intended for use which requires them to be moved frequently can be made approximately 2 feet or shorter in length for the fuel chamber and 16 inches, more or less, in width for the flat top surface. These small stoves may be equipped with handle and chimney-carrying rack.

Even in the 20th century a very considerable portion of the world's people do their cooking over open fires. Recourse to open fire cooking is not a matter of choice but of economic necessity in many parts of the world. The stove of the present invention is so simple and cheap that it is an affordable blessing to a great portion of the people who now must cook over open fires.

The stove of the invention is a useful device for campers and back-packers who may spend lengthy periods in wilderness areas. The stove will burn almost any reasonably dry organic material. Sufficient and adequate fuel can be found in almost any type of wilderness area. Use of this type of stove will go far to prevent the accidental and serious fires which result from the use of poorly attended or unattended open fires.

Whether used indoors or outdoors, the stove provides considerable safety. When the stove is loaded and combustion is initiated, the fuel chamber is, as a practical matter, very nearly hermetically sealed, having only the air inlet and chimney openings. The fire can be easily and almost instantaneously extinguished by closing off (covering) the air inlet opening with the spatulate member. In addition to being an excellent safety feature, the capability to quickly extinguish the fire also provides fuel economy by permitting subsequent use of all unburned fuel remaining in the combustion chamber. The unburned fuel is pre-seasoned for easy lighting.

I claim:

1. A stove consisting essentially of:

1. an elongated shallow, open trough-shaped fuel chamber adapted to be filled from its bottom almost to its top with fuel,
2. a door closing one end of said chamber, said door being openable to permit introduction of fuel,
3. a flat generally rectangular surface member closing the top of the trough-shaped fuel chamber,
4. said flat surface member having a first opening at the door end of the fuel chamber and a second opening at the opposite end of the chamber, said second opening serving as the sole air inlet to the fuel chamber when the stove is in operation,
5. a chimney communicating with said first opening,
6. an adjustable closure member for said second opening to regulate admission of air into said fuel chamber,
7. said stove during operation being completely closed except for the two openings in said flat surface member.

2. A stove as defined in claim 1 wherein the chimney generally contains a damper.

* * * * *